US006473928B1

(12) United States Patent
Veloskey et al.

(10) Patent No.: US 6,473,928 B1
(45) Date of Patent: Nov. 5, 2002

(54) MAGNETIC CONTROL VALVE FOR A SUCTION POWERED POOL CLEANER

(75) Inventors: Thomas E. Veloskey, San Marcos, CA (US); Justin A. Forbes, Cardiff, CA (US); Jeffrey A. Wichmann, Cardiff, CA (US); Ronald J. Sargent, Cape Coral, FL (US)

(73) Assignee: Polaris Pool Systems, Inc., Vista, CA (US)

( * ) Notice: Subject to any disclaimer, the term of this patent is extended or adjusted under 35 U.S.C. 154(b) by 29 days.

(21) Appl. No.: 09/855,922

(22) Filed: May 15, 2001

(51) Int. Cl.[7] ..... E04H 4/16

(52) U.S. Cl. ..... 15/1.7; 210/169; 137/624.14; 137/907; 137/909

(58) Field of Search ..... 15/1.7, 404; 137/624.14, 137/907, 909; 210/169

(56) References Cited

U.S. PATENT DOCUMENTS

| | | | | |
|---|---|---|---|---|
| 4,729,406 A | | 3/1988 | Frentzel | 137/624.14 |
| 5,265,638 A | | 11/1993 | Fischer et al. | 127/624.14 |
| 5,285,547 A | | 2/1994 | Sebor | 15/1.7 |
| 5,337,433 A | | 8/1994 | Gould et al. | 15/1.7 |
| 5,384,928 A | | 1/1995 | Khoury | 15/1.7 |
| 5,581,826 A | | 12/1996 | Edwards | 137/624.14 |
| 5,634,229 A | | 6/1997 | Stoltz | 15/1.7 |
| 5,655,246 A | | 8/1997 | Chang | 15/1.7 |
| 5,706,540 A | | 1/1998 | Niewiarowski | 15/1.7 |
| 5,737,791 A | | 4/1998 | Durigon | 15/1.7 |
| 5,794,293 A | | 8/1998 | Hoffinger | 15/1.7 |
| 5,992,451 A | | 11/1999 | Chang | 137/624.14 |
| 6,098,228 A | | 8/2000 | Chang | 15/1.7 |
| 6,112,354 A | * | 9/2000 | Stoltz et al. | 15/1.7 |
| 6,119,293 A | | 9/2000 | Phillipson et al. | 15/1.7 |
| 6,125,492 A | | 10/2000 | Prowse | 15/1.7 |
| 6,298,513 B1 | * | 10/2001 | Rief et al. | 15/1.7 |

* cited by examiner

*Primary Examiner*—Gary K. Graham
(74) *Attorney, Agent, or Firm*—Kelly Bauersfeld Lowry & Kelley, LLP

(57) ABSTRACT

A magnetic control valve is provided in a suction powered pool cleaner of the type for vacuuming dirt and debris from submerged floor and side wall surfaces of a swimming pool. The pool cleaner comprises a head defining a suction inlet for vacuum inflow of water and debris into a plenum chamber, and further through a suction tube adapted for connection via a vacuum hose to a conventional pool water filtration system. The control valve includes an oscillatory valve member movable between open and substantially closed positions relative to an upstream end of the suction tube to produce pressure fluctuations causing the cleaner to advance in steps over submerged pool surfaces. Oscillatory driving of the valve head is assisted by permanent magnets mounted on the valve member and cleaner head to generate repulsion forces as the valve head respectively approaches the open and closed positions.

45 Claims, 6 Drawing Sheets

MAGNETIC CONTROL VALVE FOR A SUCTION POWERED POOL CLEANER

BACKGROUND OF THE INVENTION

This invention relates generally to improvements in automatic pool cleaning devices designed for travel over submerged floor and sidewall surfaces of a swimming pool or the like to pick up and collect accumulated debris such as leaves, twigs, sand and silt. More particularly, this invention relates to an improved pool cleaner of the so-called suction or vacuum powered type, having means for cyclic interruption of water flow to generate pulsating forces which cause the pool cleaner to advance in steps over submerged pool surfaces. The present invention is particularly directed to an improved control valve having magnet means for improved oscillatory movement to interrupt the water flow and thereby generate the requisite pulsating forces to drive the cleaner over submerged pool surfaces.

Pool cleaner devices are generally well known in the art for use in maintaining residential and commercial swimming pools in a clean and attractive condition. In this regard, swimming pools conventionally include a water filtration system including a pump for drawing or suctioning water from the pool for circulation through a filter canister having filter media therein to remove and collect water-entrained debris such as leaves and twigs as well as fine particulate including sand and silt. From the filter canister, the water is recirculated to the pool via one or more return lines. Such filtration system is normally operated for several hours on a daily basis and serves, in combination with traditional chemical treatments such as chlorination or the like, to maintain the pool water in a clean and clear sanitary state. However, the water filtration system is ineffective to filter out debris which settles onto submerged floor and side wall surfaces of the swimming pool. In the past, settled debris has typically been removed by coupling a vacuum hose to the suction side of the pool water filtration system, such as by connecting the vacuum hose to a skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a labor intensive task and is thus not typically performed by the pool owner or pool cleaning service personnel on a daily basis.

Automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about within a swimming pool to dislodge and collect settled debris. In one form, the pool cleaner is connected to the return or pressure side of the filtration system for receiving positive pressure water which powers a turbine or the like for rotatably driving cleaner wheels, and also functions by venturi action to draw settled debris into a filter bag. See, for example, U.S. Pat. Nos. 3,882,574; 4,558,479; 4,589,986; and 4,734,954. In another form, the pool cleaner is coupled to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,351,077; 4,642,833; 4,742,593; 4,761,848; 4,769,867; 4,807,318; 5,265,297; 5,315,728; 5,450,645; and 5,634,229.

While both positive pressure and suction powered pool cleaners have proven to be generally effective in cleaning settled debris and the like from submerged pool surfaces, various customer preferences and installation considerations have been instrumental in causing an individual customer to choose one cleaner type over the other. For example, by comparison, positive pressure type cleaners are generally regarded as providing better collection of large debris such as leaves in a removable filter bag, to prevent such large debris from being drawn into and potentially clogging the filter canister of the pool water filtration system. However, such positive pressure cleaners often require a booster pump and/or installation of an additional dedicated water return line to be integrated into the filtration system, whereby the overall cost of installing a positive pressure cleaner particularly in an existing pool can be significant. By contrast, a suction side cleaner can often be coupled by a vacuum hose directly into the existing skimmer well of a pool, for relatively simplified connection to the suction side of the filtration system in a pool that is not equipped with a pre-installed suction side cleaner flow line. Moreover, suction side cleaners are designed for operation without requiring an additional booster pump. Accordingly, suction side cleaners have tended to be somewhat less costly to install, in comparison with pressure side cleaners.

Most suction side cleaners currently available on the market utilize a valve member typically in the form of a diaphragm or shuttle type valve adapted for movement between open and closed positions at a cyclic rate to disrupt the suction flow in a manner creating pressure surges or pulsations of sufficient magnitude to propel the cleaner in a forward direction over submerged pool surfaces in a series of incremental steps. However, this valve member has been susceptible to clogging upon ingestion of debris vacuumed from a submerged pool surface. Clogging of the valve member not only results in undesirable stalling or interruption in cleaner operation, but also creates a risk of cavitation and potential failure of the filtration system pump.

U.S. Pat. No. 6,112,354 discloses an improved suction powered pool cleaner having an oscillatory valve member for generating the requisite pressure surges to drive the pool cleaner over submerged pool surfaces, but wherein the valve member swings to an open position substantially out of alignment with the debris and water flow path to minimize the risk of clogging. In this design, the valve member is mounted for oscillatory movement between the open position and a substantially but preferably incomplete closed position relative to an upstream end of a suction tube through which debris and water are vacuumed, with a spring biasing the valve member toward the open position. The suction flow through the suction tube draws the spring-loaded valve member toward the closed position to achieve momentary substantial interruption of the water flow, accompanied by an increasing spring force which eventually urges the valve member to swing back toward the open position thereby resulting in oscillatory valve member movement and generation of the desired pressure surges to drive the cleaner within the swimming pool.

The present invention provides further improvements in pool cleaners of the suction powered type, particularly of the type described in U.S. Pat. No. 6,112,354, and more particularly with respect to providing an improved control valve oscillatory drive means for generating the requisite pressure fluctuations or surges to propel the cleaner over submerged pool floor and side wall surfaces. The present invention fulfills these needs and provides further related advantages.

SUMMARY OF THE INVENTION

In accordance with the invention, an improved oscillatory control valve is provided in a suction powered pool cleaner such as the pool cleaner disclosed in U.S. Pat. No. 6,112,354 for vacuuming dirt and debris from submerged floor and side wall surfaces of a swimming pool or the like. The improved control valve is mounted at the upstream end of a suction tube for movement between an open position and a substantially closed position to substantially interrupt the water flow through the suction tube in a cyclic manner and thereby produce a succession of pressure fluctuations or pulsations effective to drive the pool cleaner over submerged pool surfaces in a series of small steps. Oscillatory driving of the control valve is assisted by permanent magnets which generate repulsion forces as the valve approaches the open and closed positions, respectively, to reverse the direction of control valve movement.

In a preferred form, the suction powered pool cleaner comprises a compact housing or head adapted for connection to a vacuum hose or the like coupled in turn to the suction side of a conventional pool water filtration system. The cleaner head defines a suction inlet through which water and debris are drawn from an underlying pool surface for flow to the vacuum hose. A flexible perforated mat or disk is carried by the cleaner head to extend radially outwardly therefrom in surrounding relation to the suction inlet. Water is drawn radially inwardly beneath as well as downwardly through the perforated disk to sweep dirt and debris from the underlying pool surface for flow through the suction inlet into a plenum chamber formed within the cleaner head. From the plenum chamber, the water and entrained debris are drawn further through the suction tube and the vacuum hose to the pool water filtration system.

The control valve is mounted within the plenum chamber of the cleaner head, generally at an upstream end of the suction tube, for oscillatory movement between an open position retracted substantially from and disposed generally out of alignment with the suction tube, and a substantially closed position overlying the upstream end of the suction tube for substantially obstructing water flow from the plenum chamber to the suction tube. In the preferred form, the control valve comprises a valve member mounted for pivotal swinging movement between the open and substantially closed positions.

At least one permanent magnet is mounted on or otherwise carried for movement with the valve member between the open and closed positions. This valve member magnet is positioned for movement respectively into general alignment and/or magnetic interaction with at least one first and second stationary permanent magnets mounted on the cleaner head, upon valve member movement respectively to the open and closed positions. Importantly, these permanent magnets are oriented with like poles presented toward each other, so that magnetic repulsion forces are generated as the valve member moves toward the open and closed positions. The valve member is thus magnetically biased to a normal or neutral position generally mid-way between the open and closed positions.

In operation, suction water flow from the plenum chamber into the suction tube draws the valve member toward the substantially closed position. As the valve member approaches the closed position, the valve member magnet approaches the at least one associated stationary magnet with resulting increase in repulsion force which, in combination with the interrupted water flow, ultimately overcomes the suction force to reverse the direction of valve member movement. The valve member then swings back past the neutral position and toward the open position with the valve member magnet approaching the opposite at least one stationary magnet with resulting increase in repulsion force which again ultimately reverses the direction of valve member movement. Thus, the permanent magnets drive the valve member through an oscillatory motion which cyclically interrupts the water flow through the suction tube to generate the repeated pressure pulsations for driving the pool cleaner over submerged pool surfaces.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
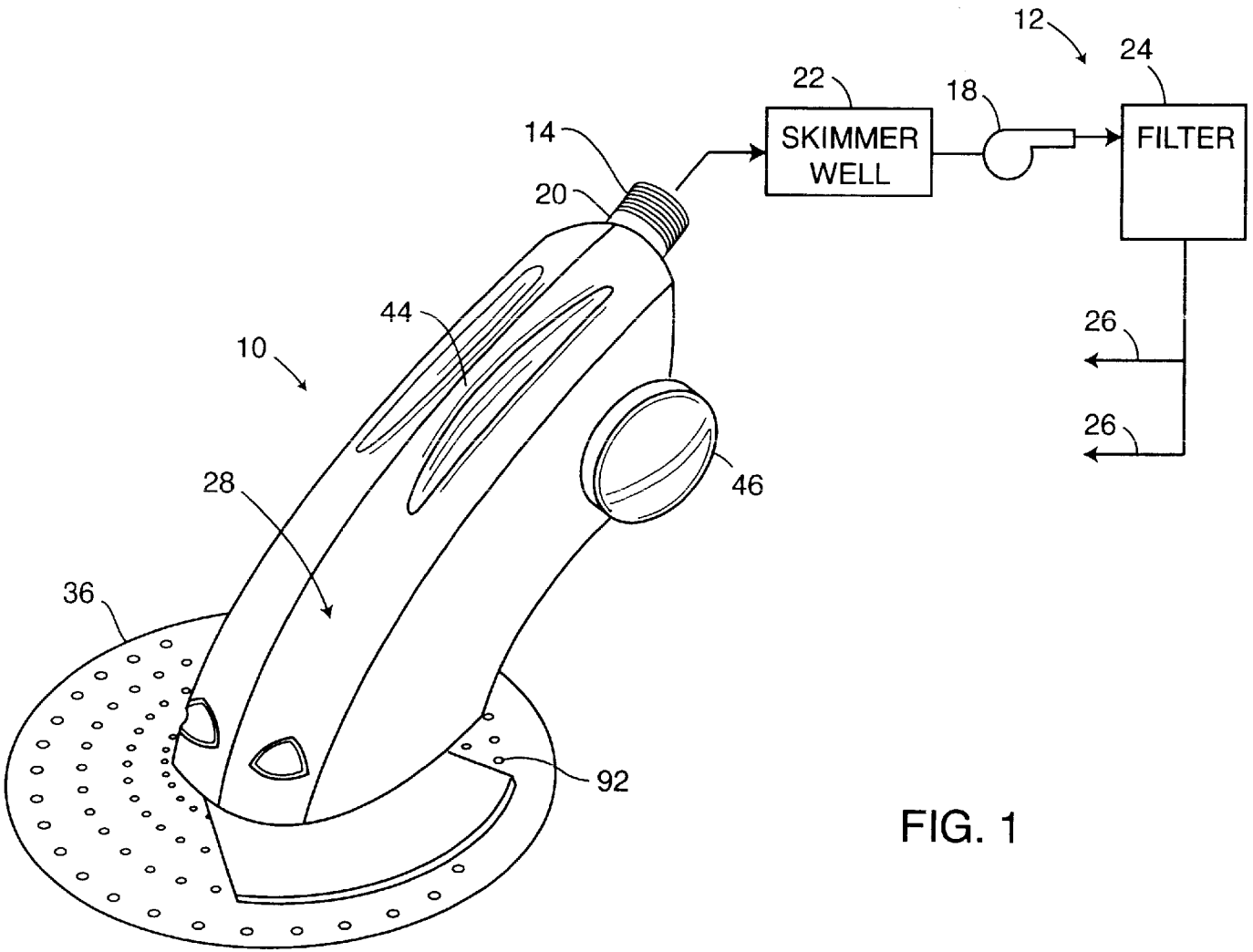
FIG. 1 is a perspective view illustrating a suction powered pool cleaner incorporating a magnetic control valve in accordance with the invention, and showing the pool cleaner in operative relation with a conventional pool water filtration system.

As shown in the exemplary drawings, an automatic pool cleaner referred to generally by the reference numeral 10 is provided for vacuuming debris such as leaves and twigs as well as small particulate such as sand and silt settled upon submerged floor and side wall surfaces of a swimming pool or the like. The pool cleaner 10 is powered by a suction or vacuum source, such as by connection to a conventional pool water filtration system 12 shown schematically in FIG. 1, by means of a flexible vacuum hose 14. In operation, water is drawn through the pool cleaner 10 in a manner for water-borne vacuuming of debris settled onto submerged pool surfaces, and wherein this flow of water provides a power source for driving a main control valve 16 (FIGS. 3–8) in an oscillatory or reciprocatory manner to induce pressure fluctuations or pulsations which drive the cleaner 10 along a forward path of motion in a succession of small incremental steps. In accordance with the invention, the main control valve 16 employs magnet means which acts in cooperation with the suction water flow to produce the desired oscillatory movement and resultant cleaner-driving pressure fluctuations.

The pool cleaner 10 shown in the illustrative drawings conforms in general terms in construction and operation to the pool cleaner shown and described in U.S. Pat. No. 6,112,354 which is incorporated by reference herein. More particularly, by way of a brief overall description, the illustrative pool cleaner 10 is shown (FIG. 1) coupled via the vacuum hose 14 to the suction side of a pump 18 forming part of the conventional pool water filtration system 12. In a typical installation, the vacuum hose 14 is connected between a cylindrical suction fitting 20 on the pool cleaner 10 and a skimmer well 22 mounted typically at one edge of the swimming pool at a location generally at the water's surface. The pump 18 draws pool water through the skimmer well 22 for discharge flow through a filter canister 24 having a suitable filter media (not shown) therein for filtering and collecting water-entrained particulate and debris. From the filter canister 24, the water is recirculated to the swimming pool typically through a plurality of return lines 26. When the pool cleaner 10 is coupled via the vacuum hose to the skimmer well 22, the pump 18 draws water under a vacuum or negative pressure through the cleaner 10, wherein this suction flow is utilized for powering the pool cleaner to travel about in a substantially random pattern within the pool while vacuuming debris and particulate settled onto submerged pool surfaces for collection within the filter canister 24. Alternately, it will be recognized and understood that some swimming pools may be equipped with a dedicated suction cleaner flow line (not shown) coupled directly from the pool wall to the filtration system 12, in which case the vacuum hose 14 would be coupled to said suction flow line.

Figure 2:
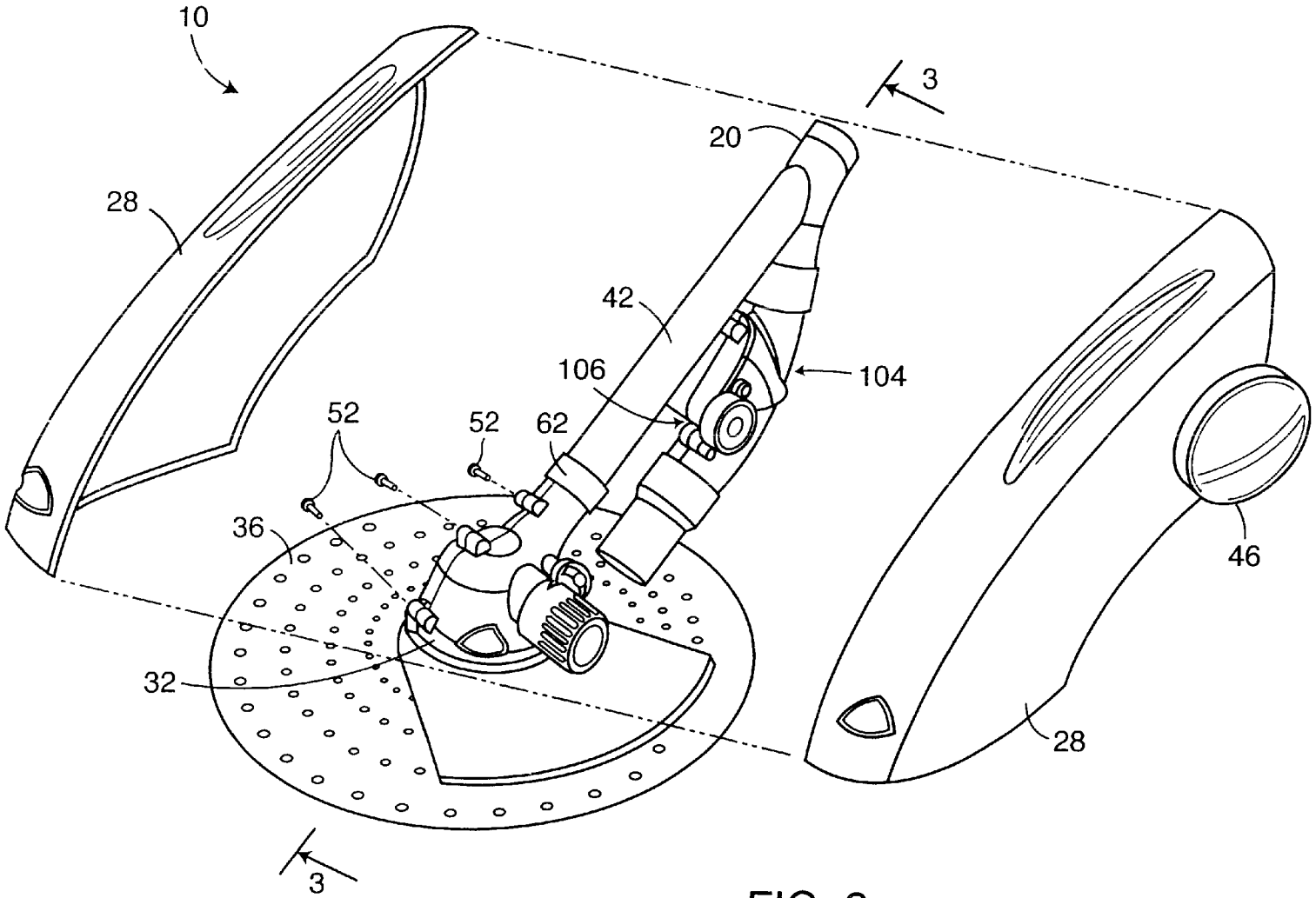
FIG. 2 is an exploded perspective view of the pool cleaner shown in FIG. 1, illustrating an outer housing shell in exploded relation with an internal cleaner head.

As shown in FIGS. 1 and 2, the pool cleaner 10 generally comprises a relatively compact outer housing 28 encasing or mounted about an inner housing or head 30. The head 30 includes a lower foot 32 defining a downwardly open suction inlet 34 (FIGS. 3 and 4) for vacuum inflow of water-borne debris, wherein the foot 32 is surrounded by a generally circular and relatively flexible mat or disk 36 adapted to drape downwardly about the suction inlet 34 and to extend radially outwardly therefrom to engage the underlying pool surface. Water-borne debris is drawn through the suction inlet 34 initially into a relatively large plenum chamber 40, and then through a primary suction tube 42 which is oriented at an incline to extend angularly upwardly and forwardly from the foot 32 for appropriate connection to the vacuum hose 14. In this regard, the suction fitting 20 (FIGS. 1 and 2) preferably comprises a swivel coupling for connecting the upper or downstream end of the primary suction tube 42 to the vacuum hose 14. The outer housing 28 conveniently comprises a relatively lightweight and decorative outer shell of molded plastic components or the like, shaped if desired to include an accessible handle 44 (FIG. 1) for lifting and carrying the pool cleaner 10. In addition, FIGS. 1 and 2 show the outer housing 28 to include at least one optional nose wheel 46 or other bumper means carried at a front edge of the cleaner for rollingly engaging a vertically extending pool side wall surface during cleaner operation.

The internal cleaner head 30 also comprises a pair of generally shell-shaped housing members of molded plastic or the like and adapted for appropriate interconnection by screws 52 (FIG. 2) or the like to form a generally dome-shaped and downwardly open structure defining the plenum chamber 40 (viewed best in FIGS. 3–8). The construction details of these assembled cleaner head components, and the assembly thereof with the resilient mat or disk 36, are shown and described more fully in U.S. Pat. No. 6,112,354. Importantly, the assembled shell-shaped components of the cleaner head 30 also define a cylindrical suction fitting or port 62 (FIGS. 3–7) which forms a water flow outlet at an upper zone of the plenum chamber 40 opening in a direction inclined vertically upwardly and angularly forwardly relative to the foot 32 and the suction inlet 34 defined thereby. This suction fitting 62 is coupled in a suitable manner to a lower or upstream end of the primary suction tube 42. As shown, the primary suction tube 42 extends further upwardly and forwardly at the same angle of inclination, terminating in an upper or downstream end for connection by the suction fitting 20 to the vacuum hose 14.

The main control valve 16 is pivotally supported by the cleaner head 30 within the plenum chamber 40, at a position generally at the lower or upstream end of the primary suction tube 42. More specifically, as shown in FIGS. 3–8, the control valve 16 comprises a valve head or valve member 64 formed from molded plastic or the like and shaped to include a part-spherical ball-type surface segment 66 mounted onto a laterally extending shaft 68 having its opposite ends suitably and bearingly supported by the cleaner head 30 at opposite sides of the plenum chamber 40. The ball-shaped valve member 64 is adapted for oscillatory or reciprocatory swinging movement between a substantially closed position (FIGS. 3 and 5) obstructing but preferably not completely closing water flow from the plenum chamber 40 to the primary suction tube 42, and an open position (FIGS. 4 and 6) retracted substantially out of alignment with and thereby permitting substantially unobstructed or unimpeded flow of water from the plenum chamber 40 to the primary suction tube 42. In this regard, the valve shaft 68 supporting the ball-shaped valve member 64 extends laterally through the plenum chamber 40 at a location aligned generally with an upper marginal edge of the open upstream end of the primary suction tube 42, as viewed in FIGS. 3–4, so that the valve member 64 in the open position is disposed substantially to one side of an axial centerline through the primary suction tube 42, to permit substantially unobstructed flow of water and water-borne debris through said suction tube.

In accordance with the present invention, and as shown in detail in FIGS. 3–8), the valve member 64 carries at least one magnet 70 shown mounted within a shallow pocket 72 at the free or outboard side edge of the valve member opposite the support shaft 68. This magnet 70 preferably comprises a compact magnet having a relatively low weight and relatively high and long term field strength, such as a neodymium-iron-boron permanent magnet. The magnet 70 is desirably encapulated within the pocket 72, as by means of a cap plate 74 formed from plastic or the like and secured as by a watertight adhesive to fit over and close the pocket 72 to isolate and prevent direct contact between the magnet 70 and potentially corrosive pool water. The magnet 70 is carried by or otherwise movable with the valve member 64 upon displacement thereof between the substantially closed and open positions.

A pair of additional magnets 76 and 78 are mounted on the cleaner head 30 within the plenum chamber 40 for magnetic reaction with the movable valve member magnet 70 during valve member movement between the closed and open positions. More particularly, at least one first reaction magnet 76 is mounted in a fixed or stationary position within the plenum chamber 40 at a location spaced a short distance below the open upstream end of the primary suction tube 42 (FIGS. 3 and 5), for general alignment with the movable valve magnet 70 as the valve member 64 approaches the substantially closed position. Similarly, at least one second reaction magnet 78 is mounted in a fixed or stationary position within the plenum chamber 40 at a location generally opposite the suction tube 42 (FIGS. 4 and 6), for general alignment with the movable valve magnet 70 as the valve member 64 approaches the open position. Both of these stationary reaction magnets 76 and 78 also comprise, in the preferred form, a compact magnet having a relatively low weight and relatively high and long term field strength, such as a neodymium-iron-boron permanent magnet. In addition, to prevent direct magnet contact with the pool water, these magnets 76 and 78 are desirably encapsulated within shell-shaped covers 80 formed from a molded plastic or the like to isolate the magnets from potentially damaging direct contact with the pool water. While these magnets 76, 78 are shown and described as being mounted in fixed or stationary positions, it will be understood that they may be adjustably positioned for optimal alignment with the valve member magnet 70, as will be described.

Figures 3, 9:
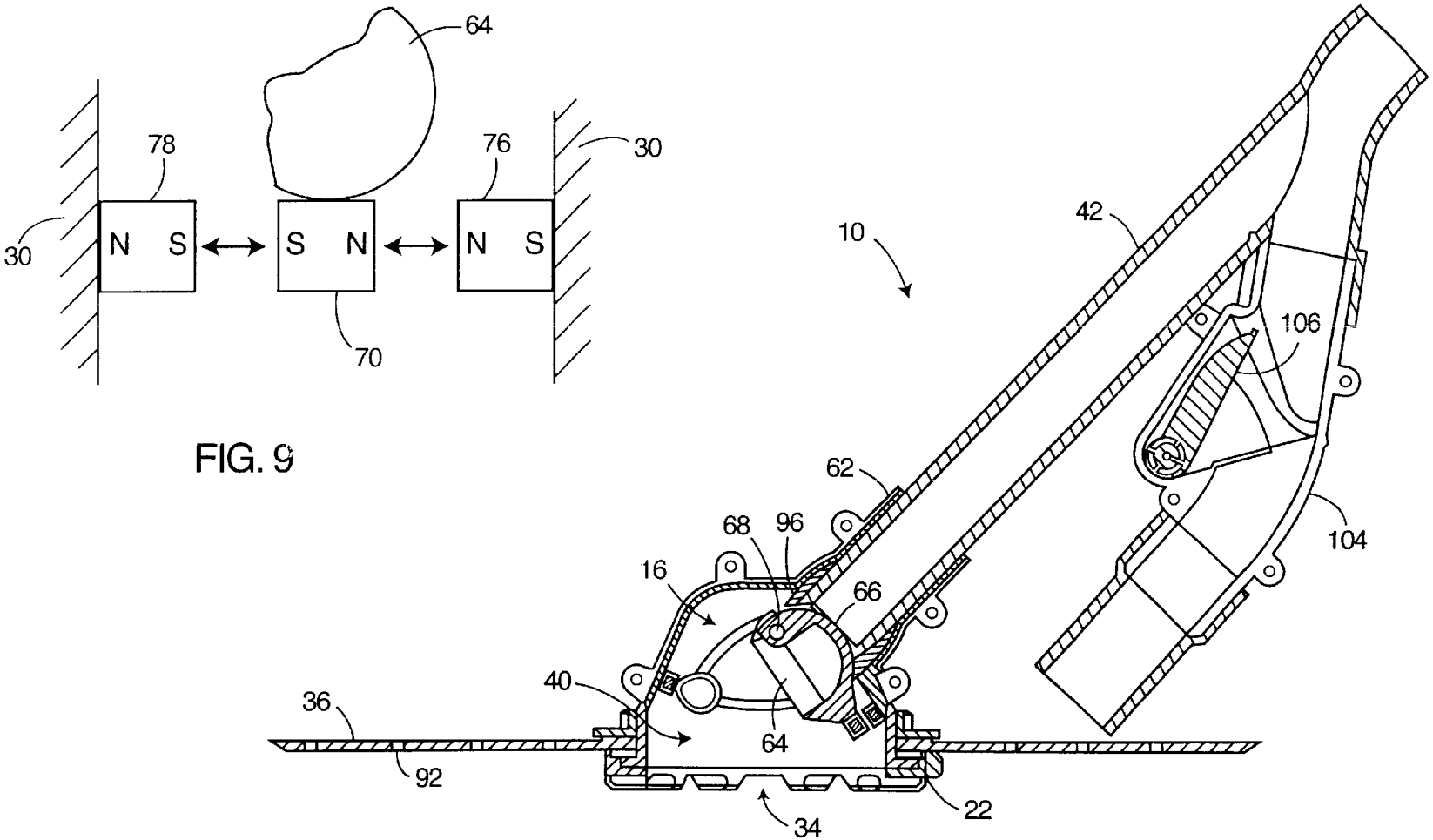
FIG. 3 is a longitudinal vertical sectional view taken generally on the line 3—3 of FIG. 2, and showing a magnetic control valve mounted within the cleaner head and oriented in a substantially closed position.
FIG. 9 is a schematic diagram illustrating the relative orientation of magnets used in the magnetic control valve.

The reaction magnets 76, 78 mounted on the cleaner head 30 are oriented to present like poles toward the movable valve magnet 70 carried by the oscillatory valve member 64, as illustrated in schematic form in FIG. 9. With this construction, movement of the valve member 64 toward the substantially closed position is accompanied by a progressively increasing magnetic repulsion force as the movable valve magnet 70 approaches the first reaction magnet 76. Similarly, movement of the valve member 64 toward the open position is accompanied by a progressively increasing magnetic repulsion force as the movable valve magnet 70 approaches the second reaction magnet 78. These magnetic repulsion forces cooperate, as will be described in more detail, to provide effective and reliable back-and-forth oscillatory movement of the valve member 64 for driving the pool cleaner 10 over submerged pool surfaces.

During operation of the pool cleaner 10, water is drawn by vacuum through the suction inlet 34 into the plenum chamber 40. In this regard, water is drawn radially inwardly beneath the flexible mat or disk 36, and also drawn downwardly through an array of mat perforations 92 into the plenum chamber 40. This suction water flow picks up debris which has settled upon the pool surface. This water-borne flow of debris flows, at negative pressure, into the open upstream end of the primary suction tube 42 and further through the vacuum hose 14 for flow to the pool filtration system (FIG. 1) which separates and captures the debris while returning filtered water to the pool.

Importantly, as the water-borne debris flows from the plenum chamber 40 into the primary suction tube 42, a pressure differential attributable to the comparatively smaller flow area of the suction tube 42 and resultant higher velocity water flow therein, relative to the plenum chamber 40, draws the ball segment 66 of the valve member 64 toward the substantially closed position. More particularly, as viewed in FIGS. 3 and 5, as the suction flow entering the tube 42 reaches a critical velocity, this pressure differential rapidly draws the valve member ball segment 66 into close proximity with a resilient annular valve seat 96 (FIGS. 3–4) mounted at the upstream end of the primary suction tube 42, whereupon water flow into the suction tube 42 is substantially obstructed. In addition, as the valve member 64 approaches this substantially closed position, the movable valve magnet 70 is displaced progressively toward the associated first reaction magnet 76, resulting in a progressively increasing magnetic repulsion force which resists further closure movement of the valve member. As described in U.S. Pat. No. 6,112,354, a stop (not shown) may be provided to prevent complete closure of the ball segment 66 onto the valve seat 96, whereby there is at least some water flow to the suction tube 42 at all times.

Figure 4:
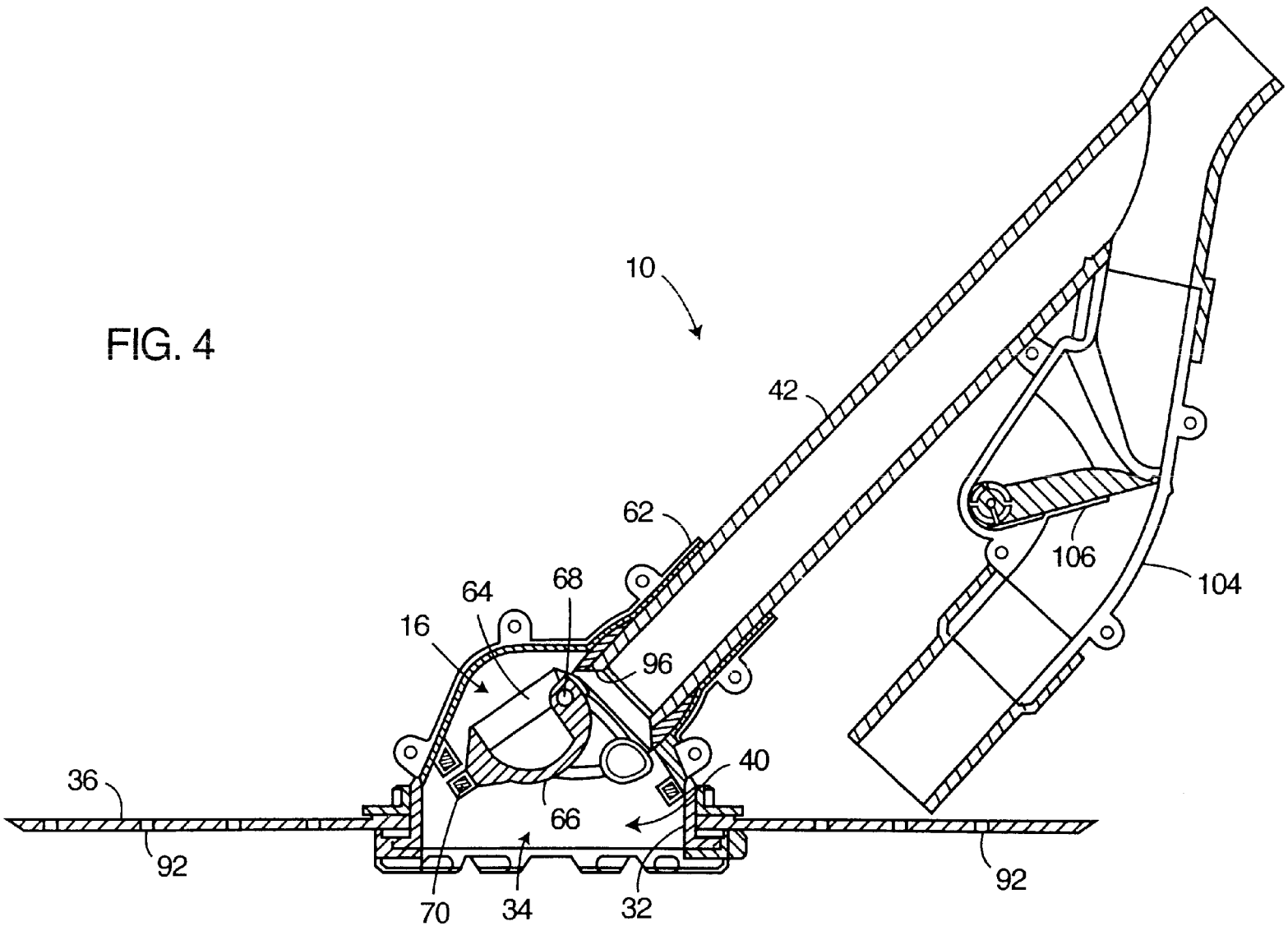
FIG. 4 is a longitudinal vertical sectional view similar to FIG. 3, and illustrating the magnetic control valve in an open position.
Figure 5:
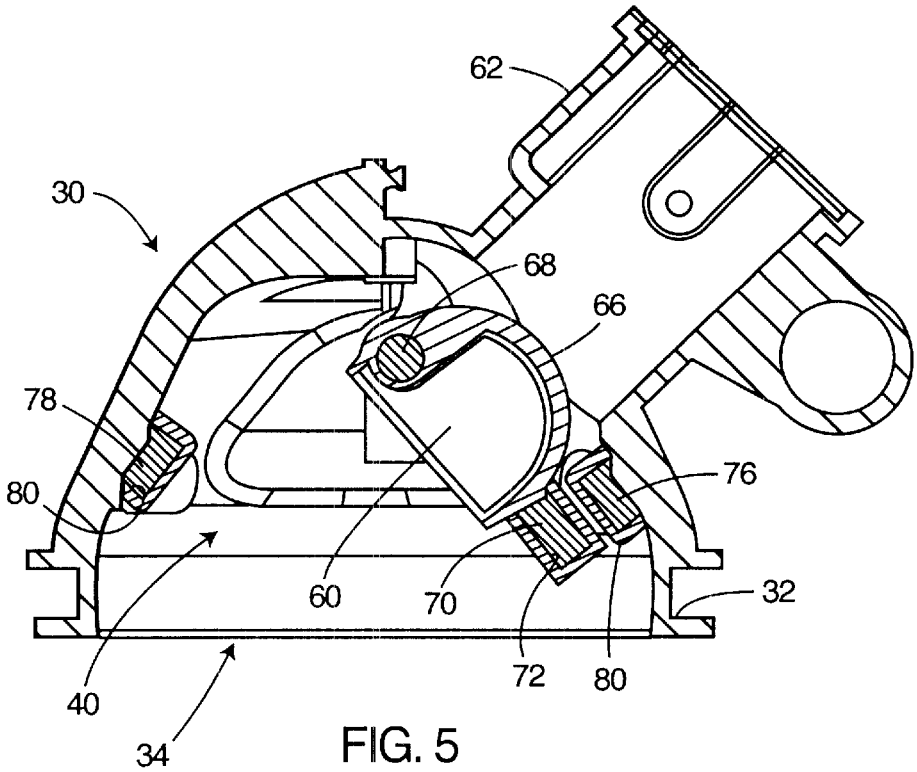
FIG. 5 is an enlarged vertical sectional view of the cleaner head, similar to a portion of FIG. 3, and showing the magnetic control valve in the substantially closed position.
Figure 6:
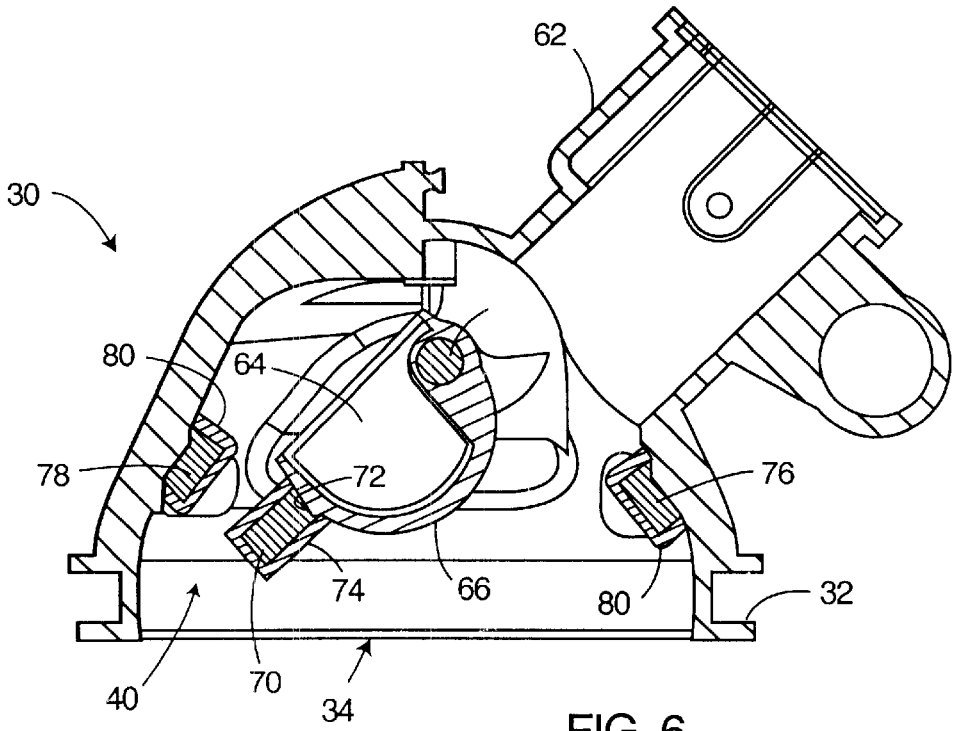
FIG. 6 is an enlarged vertical sectional view similar to FIG. 5, and depicting the magnetic control valve is the open position.
Figure 7:
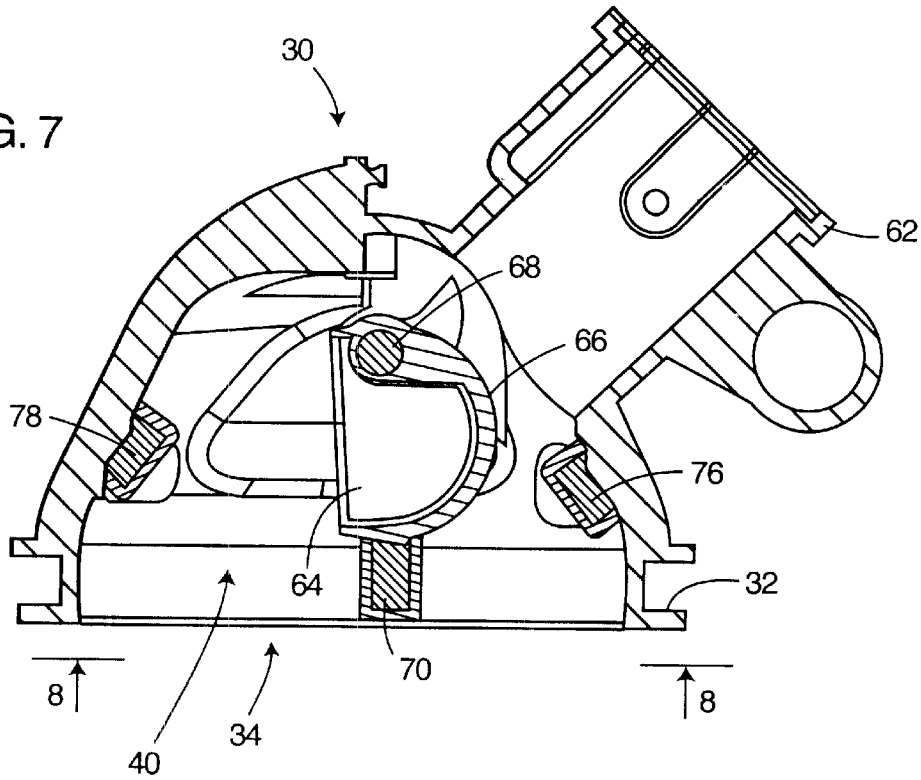
FIG. 7 is an enlarged vertical sectional view similar to FIGS. 5 and 6, and illustrating the magnetic control valve in a neutral position.
Figure 8:
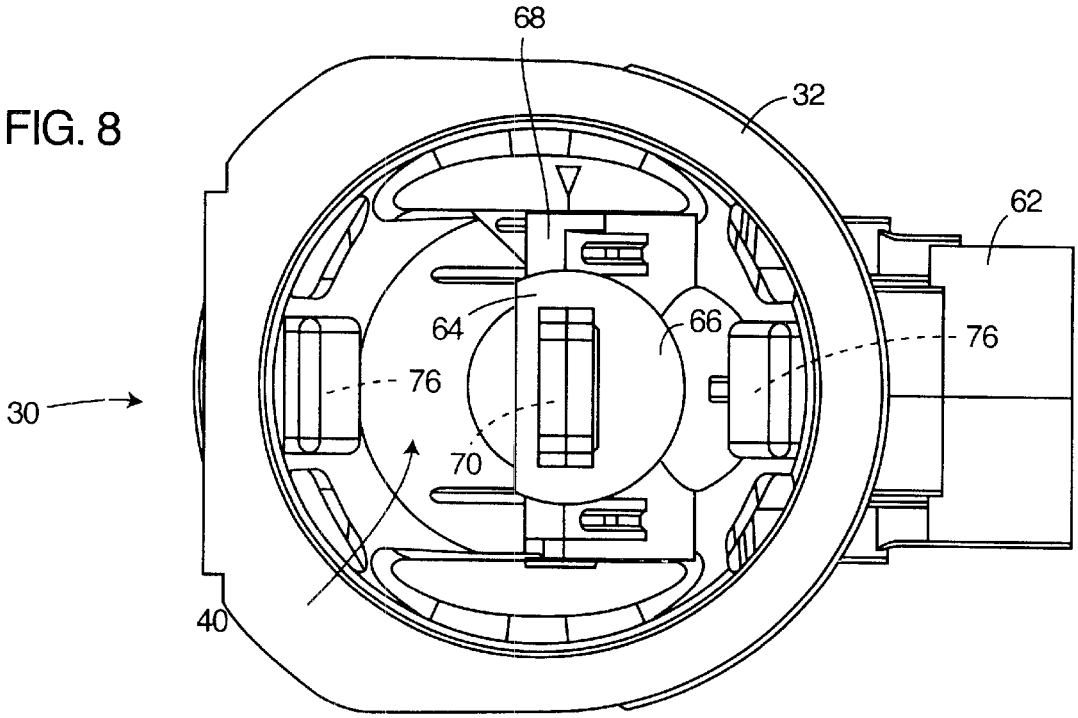
FIG. 8 is a bottom plan view of the cleaner head, taken generally on the line 8—8 of FIG. 7.

This magnetic repulsion force of increasing strength, acting between the movable valve magnet 70 and the first reaction magnet 76, eventually overcomes the suction forces acting upon the valve member 64 to cause the valve member to reverse direction and move away from the substantially closed position. The valve member 64 thus swings back to and through a neutral position (FIGS. 7–8) and further toward the open position (FIGS. 4 and 6). As the movable valve magnet 70 approaches the oppositely-positioned second reaction magnet 78, a progressively increasing magnet repulsion force is again generated for ultimately overcoming valve member momentum and again reversing the direction of valve member movement. The valve member 64 is thus angularly displaced back to and through the neutral position and further toward the substantially closed position, as previously described.

In this manner, the valve member 64 is repeatedly and relatively rapidly driven in a cyclic or oscillatory fashion, between the open and substantially closed positions. This results in a rapid succession of pressure fluctuations or pulsations within the cleaner head 30, to induce a water hammer effect acting in the direction of the water flow, namely, upwardly and forwardly generally along the axis of the primary suction tube 42. These pulsations effectively drive or transport the pool cleaner 10 in a generally forward direction within the swimming pool, in a series of small incremental hop-like steps to traverse submerged pool surfaces to vacuum debris settled thereon. As the cleaner 10 is driven forwardly in this manner, water-borne debris is swept from the underlying pool surface and through the primary suction tube 42, with minimal risk of clogging or fouling the interface between the valve member 64 and the annular valve seat 96. That is, in the open position, the valve member 64 is substantially out of alignment with the flow to and through the primary suction tube 42.

The specific operating characteristics of the pool cleaner are dependent upon a variety of factors, including the vacuum pressure applied via the vacuum hose 14. In addition, the cyclic rate of the valve member movement can be adjusted by variably selecting the magnetic strengths or the relative positions of the movable valve magnet 70 and the associated reaction magnets 76, 78. By using stationary magnets of different strengths, the specific neutral position of the valve member 64 (FIGS. 7–8) can be variably selected. Moreover, it will be recognized and understood that the movable valve member 64 may be mechanically supported in alternative orientations, such as for linear back-and-forth movement between the open and substantially closed positions. Further, it will be appreciated that the movable magnet 70 may be mounted on alternative structure movable with but not mounted directly on the movable valve member 64. In addition, as shown in FIGS. 3–4, the cleaner head 30 may optionally and additionally include a bypass suction tube 104 having a bypass valve 106 mounted therein for coordinated operation with the main control valve 16, as shown and described in U.S. Pat. No. 6,112,354.

The suction powered pool cleaner of the present invention thus provides an improved ball-type main control valve 16 with magnetic means for cyclic movement to induce pressure fluctuations or pulsations for driving the cleaner forwardly in a succession of incremental steps. The ball-type valve moves in an oscillatory or reciprocatory manner between a substantially closed position interrupting water flow through the primary suction tube 42, and an open position accommodating substantially unobstructed flow of water-borne debris in a manner which is resistant to clogging.

A variety of further modifications and improvements in and to the suction powered pool cleaner of the present invention will be apparent to those persons skilled in the art. Accordingly, no limitation is intended by way of the foregoing description and accompanying drawings, except as set forth in the appended claims.

What is claimed is:

1. A pool cleaner for connection to a suction source, said pool cleaner comprising:

a cleaner head including housing means forming a plenum chamber and a downwardly open suction inlet for inflow of water and water-borne debris from a submerged surface of a swimming pool into said plenum chamber, said cleaner head further including a suction tube having a first end coupled to said housing means in flow communication with said plenum chamber and a second end adapted for connection to a suction source, said suction tube extending angularly upwardly and forwardly from said housing means; and a magnetic control valve including a valve member mounted within said plenum chamber for movement back-and-forth between an open position to permit substantially unobstructed flow of water from said plenum chamber to said suction tube, and a substantially closed position to obstruct flow of water from said plenum chamber to said suction tube;

said magnetic control valve further including at least one magnet movable with said valve member, at least one first reaction magnet mounted on said cleaner head in a position for reacting with said valve member magnet to produce a repulsion force upon movement of said valve member toward said substantially closed position, and at least one second reaction magnet mounted on said cleaner head in a position for reacting with said valve member magnet to produce a repulsion force upon movement of said valve member toward said open position.

2. The pool cleaner of claim 1 wherein each of said valve member magnet and said first and second reaction magnets comprises a permanent magnet.

3. The pool cleaner of claim 1 wherein each of said valve member magnet and said first and second reaction magnets comprises a neodymium-iron-boron magnet.

4. The pool cleaner of claim 1 further including means for isolating each of said valve member magnet and said first and second reaction magnets from direct contact with pool water.

5. The pool cleaner of claim 1 wherein said valve member magnet is mounted on said valve member for movement therewith.

6. The pool cleaner of claim 1 wherein said valve member is pivotally mounted on said cleaner head for swinging movement between said open and substantially closed positions.

7. The pool cleaner of claim 6 wherein said valve member in said open position is disposed substantially out of alignment with said suction tube.

8. The pool cleaner of claim 1 wherein said first and second reaction magnets are mounted on said cleaner head in stationary positions.

9. The pool cleaner of claim 1 wherein said first and second reaction magnets are mounted on said cleaner head each with like poles presented toward said valve member magnet for cooperating therewith to produce said repulsion forces upon movement of said valve member respectively toward said open and closed positions.

10. The pool cleaner of claim 1 further including a resilient annular valve seat at an upstream end of said suction tube.

11. The pool cleaner of claim 10 wherein said valve member includes a ball segment cooperating with said annular valve seat when said valve member is in said substantially closed position for obstructing water flow from said plenum chamber to said suction tube.

12. The pool cleaner of claim 1 further including an external housing on said cleaner head, said external housing including a carrying handle.

13. The pool cleaner of claim 1 further including a flexible disk carried by said cleaner head and extending radially outwardly therefrom for contacting a submerged pool surface in surrounding relation to said suction inlet, said disk having a pattern of perforations formed therein.

14. In a pool cleaner for connection to a suction source, said pool cleaner including a cleaner head defining a plenum chamber and a downwardly open suction inlet for inflow of water and water-borne debris from a submerged surface of a swimming pool into said plenum chamber, a suction tube extending angularly upwardly from said cleaner head and having a first end coupled in flow communication with said plenum chamber and a second end adapted for connection to a suction source, and a control valve including a valve member mounted within said plenum chamber for movement back-and-forth between an open position to permit substantially unobstructed flow of water from said plenum chamber to said suction tube, and a substantially closed position to obstruct flow of water from said plenum chamber to said suction tube, the improvement comprising:

at least one magnet movable with said valve member between said open and closed positions; and reaction magnet means for reacting with said valve member magnet to produce a repulsion force upon movement of said valve member from said open position toward said substantially closed position, for reversing the direction of movement of said valve member.

15. The pool cleaner of claim 14 wherein said reaction magnet means further reacts with said valve member magnet to produce a repulsion force upon movement of said valve member from said closed position toward said open position for reversing the direction of movement of said valve member.

16. The pool cleaner of claim 15 wherein said reaction magnet means comprises at least one reaction magnet mounted on said cleaner head.

17. The pool cleaner of claim 15 wherein said reaction magnet means comprises a first reaction magnet mounted on said cleaner head in a position to react with said valve member magnet to produce a repulsion force upon movement of said valve member toward said substantially closed position, and a second reaction magnet mounted on said cleaner head in a position to react with said valve member to produce a repulsion force upon movement of said valve member toward said open position.

18. The pool cleaner of claim 17 wherein each of said valve member magnet and said first and second reaction magnets comprises a permanent magnet.

19. The pool cleaner of claim 15 wherein said reaction magnet means is mounted on said cleaner head relative to said valve member magnet with like poles presented toward each other to produce said repulsion forces upon movement of said valve member respectively toward said open and closed positions.

20. The pool cleaner of claim 14 wherein each of said valve member magnet and said reaction magnet means comprises a neodymium-iron-boron magnet.

21. The pool cleaner of claim 14 further including means for isolating each of said valve member magnet and said reaction magnet means from direct contact with pool water.

22. The pool cleaner of claim 14 wherein said valve member magnet is mounted on said valve member for movement therewith.

23. The pool cleaner of claim 14 wherein said valve member is pivotally mounted on said cleaner head for swinging movement between said open and substantially closed positions.

24. The pool cleaner of claim 14 wherein said reaction magnet means is mounted on said cleaner head in a stationary manner.

25. The pool cleaner of claim 14 wherein said reaction magnet means is mounted on said cleaner head relative to said valve member magnet with like poles presented toward each other to produce said repulsion force upon movement of said valve member from said open position toward said closed position.

26. The pool cleaner of claim 14 further including a resilient annular valve seat at an upstream end of said suction tube.

27. The pool cleaner of claim 26 wherein said valve member includes a ball segment cooperating with said annular valve seat when said valve member is in said substantially closed position for obstructing water flow from said plenum chamber to said suction tube.

28. The pool cleaner of claim 14 further including a flexible disk carried by said cleaner head and extending radially outwardly therefrom for contacting a submerged pool surface in surrounding relation to said suction inlet, said disk having a pattern of perforations formed therein.

29. The pool cleaner of claim 14 further including means for reversing the direction of movement of said valve member upon movement thereof from said closed position to said open position.

30. The pool cleaner of claim 14 wherein said reaction magnet means is mounted on said cleaner head.

31. In a pool cleaner for connection to a suction source, said pool cleaner including a cleaner head defining an open suction inlet for inflow of water and water-borne debris from a submerged surface of a swimming pool, a suction port coupled in flow communication with said suction inlet and adapted for connection to a suction source, and a control valve including a valve member mounted on said cleaner head for movement back-and-forth between an open position to permit substantially unobstructed flow of water from said suction inlet to said suction port, and a substantially closed position to obstruct flow of water from said suction inlet to said suction port, the improvement comprising:

at least one magnet movable with said valve member during at least a portion of said valve member movement between said open and closed positions; and reaction magnet means for reacting with said at least one valve member magnet to produce a repulsion force upon movement of said valve member from said open position toward said substantially closed position, for reversing the direction of movement of said valve member.

32. The pool cleaner of claim 31, wherein said reaction magnet means further reacts with said valve member magnet to produce a repulsion force upon movement of said valve member from said closed position toward said open position for reversing the direction of movement of said valve member.

33. The pool cleaner of claim 32 wherein said reaction magnet means comprises at least one reaction magnet mounted on said cleaner head.

34. The pool cleaner of claim 32 wherein said reaction magnet means comprises at least one first reaction magnet mounted on said cleaner head in a position to react with said valve member magnet to produce a repulsion force upon movement of said valve member toward said substantially closed position, and at least one second reaction magnet mounted on said cleaner head in a position to react with said valve member to produce a repulsion force upon movement of said valve member toward said open position.

35. The pool cleaner of claim 31 further including means for isolating each of said valve member magnet and said reaction magnet means from direct contact with pool water.

36. The pool cleaner of claim 31 wherein said at least one valve member magnet is mounted on said valve member for movement therewith.

37. The pool cleaner of claim 31 wherein said valve member is pivotally mounted on said cleaner head for swinging movement between said open and substantially closed positions.

38. The pool cleaner of claim 31 further including means for reversing the direction of movement of said valve member upon movement thereof from said closed position to said open position.

39. The pool cleaner of claim 31 wherein said valve member upon movement to said substantially closed position momentarily interrupts water flow from said suction inlet to said suction port to induce a pressure pulsation effective to drive said cleaner head in a small incremental step.

40. The pool cleaner of claim 31 wherein said valve member movement between said open and substantially closed positions drives said cleaner head in a succession of small incremental steps.

41. The pool cleaner of claim 31 wherein said cleaner head further defines a plenum chamber disposed generally between said suction inlet and said suction port, said valve member being mounted generally within said plenum chamber.

42. The pool cleaner of claim 31 wherein suction inlet is downwardly open.

43. The pool cleaner of claim 31 wherein said suction port is formed at a first end of an elongated suction tube having an opposite end thereof adapted for connection to a suction source, said suction tube extending angularly upwardly and forwardly from said cleaner head.

44. The pool cleaner of claim 43 further including a resilient annular valve seat at an upstream end of said suction tube.

45. The pool cleaner of claim 44 further including a flexible disk carried by said cleaner head and extending radially outwardly therefrom for contacting a submerged pool surface in surrounding relation to said suction inlet, said disk having a pattern of perforations formed therein.

* * * * *